United States Patent [19]

Gunkel

[11] 3,940,903

[45] Mar. 2, 1976

[54] PREFABRICATED TRANSPORTABLE ROOM ELEMENT FOR USE IN THE CONSTRUCTION OF A PLURAL STOREY BUILDING

[75] Inventor: Dietrich Gunkel, Constance Germany

[73] Assignee: Credelca A.G., Zug, Switzerland

[22] Filed: Apr. 25, 1974

[21] Appl. No.: 464,245

[30] Foreign Application Priority Data

Apr. 25, 1973 Switzerland ..... 5949/73

[52] U.S. Cl. ..... 52/745

[51] Int. Cl.[2] ..... E04G 21/00

[58] Field of Search ..... 52/236, 745, 127, 749

[56] References Cited

UNITED STATES PATENTS

| | | | |
|---|---|---|---|
| 1,362,069 | 12/1920 | Witzel | 52/745 |
| 3,500,595 | 3/1970 | Bennett | 52/236 |
| 3,758,998 | 9/1973 | Ollis | 52/745 |
| 3,834,110 | 9/1974 | Vercelleto | 52/745 |

*Primary Examiner*—John E. Murtagh

*Attorney, Agent, or Firm*—Brumbaugh, Graves, Donohue & Raymond

[57] ABSTRACT

A prefabricated transportable room element for use in the construction of a plural storey building comprising a plurality of such room elements stacked one upon another, the room element comprising a floor panel structure and at least one vertical load-bearing structure extending upwardly of the floor panel structure, the room element having releasably connected thereto structural bracing means which is connectable to the foundation of a building and/or to the bracing means of another like room element when the room element is stacked therewith, the room element and the bracing means having buttressing surfaces which cooperate to transmit horizontal loads on the room element to the bracing means whilst allowing relative vertical movement between the room element and the bracing means when the room element is incorporated in a building with the bracing means connected to the foundation of the building and/or the bracing means of a like room element stacked with the room element and with the bracing means released from the room element.

6 Claims, 7 Drawing Figures

PREFABRICATED TRANSPORTABLE ROOM ELEMENT FOR USE IN THE CONSTRUCTION OF A PLURAL STOREY BUILDING

The present invention relates to prefabricated transportable room elements for use in the construction of a plural storey building and comprising a floor panel structure and at least one vertical load-bearing structure extending upwardly of the floor panel structure.

In contrast to a closed-sided box-like room element whose walls stand perpendicular to one another and therefore mutually brace one another horizontally, the or each vertical load-bearing structure of an open-sided room element is held horizontally only by its moment-resistant connection to the floor panel structure. In certain cases, e.g. when a building, due to its height or expanse, presents a large surface area to the wind, it may be advisable or even necessary to relieve the connection of the vertical load-bearing structure(s) to the floor panel, as well as the floor panel itself, of the considerable moments imposed thereupon. In order to accomplish this, buildings of open-sided room elements subject to high wind loading have often been provided with shear walls anchored in the foundations and extending over several storeys at right angles to the wind-loaded surface. However, such shear walls, whether they be built in situ or prefabricated, represent an element foreign to room element philosophy in that they require increased work on the building site. In order to overcome this disadvantage, the multiple-storey shear wall has often been divided into single-storey sections which were each built into a room element of the corresponding storey level. The result was a braced room element which could no longer simply be stacked upon others, but required structural inter-connection to them. Apart from the still considerable amount of site work, this entailed the disadvantage of requiring much closer manufacturing tolerances.

The present invention provides a prefabricated transportable room element for use in the construction of a plural storey building comprising a plurality of such room elements stacked one upon another, the room element comprising a floor panel structure and at least one vertical load-bearing structure extending upwardly of the floor panel structure, the room element having releasably connected thereto structural bracing means which is connectable to the foundation of a building and/or to the bracing means of another like room element when the room element is stacked therewith, the room element and the bracing means having buttressing surfaces which cooperate to transmit horizontal loads on the room element to the bracing means whilst allowing relative vertical movement between the room element and the bracing means when the room element is incorporated in a building with the bracing means connected to the foundation of the building and/or the bracing means of a like room element stacked with the room element and with the bracing means released from the room element.

If a plurality of room elements are stacked to the desired height at the desired location of the building, and if, as each room element is set in position its bracing means is released from it and connected to the foundation or to the bracing means of the element below, then a wind bracing frame complete in itself, anchored in the foundations and integrated in the building can be produced step-by-step, simultaneously with the building. The bracing frame can thus be equivalent to a vertical cantilever beam anchored at its base and extending up into the building for the desired height, and engaging the building only via the buttressing surfaces, i.e. capable of resisting only horizontal forces. Thus such a room element permits of modular erection, not only in that the wind bracing can be modularised, but rather in that the wind bracing structural modules need not be specially erected because they are already present at the right location once the corresponding room element has been set. Consequently, the field work is reduced to a minimum, since the wind bracing means can be built into the room elements in the factory and transported with them to the building site. A further advantage resulting from the parallel erection of the building and the wind bracing means is that the construction is braced against side-loads at all stages of erection without requiring the room elements themselves to be structurally anchored to the foundation or to the room elements below. Consequently the required manufacturing tolerances lie in the heretofore accustomed range. The fact that the bracing means is releasably attached to the room element and can be released from the room element as it is integrated into the wind bracing frame, thus assuring that horizontal loads imposed on the room element are transmitted to the bracing structure solely via the buttressing surfaces, means that the building and the bracing structure can be two vertically independent structural entities having the advantage that no secondary or parasitical stresses arise when they work or are subjected to wind load. The vertical independence also permits the use of bracing means in a material different from that of the room element which may have a coefficient of thermal expansion considerably different. Just as the two entitites are structurally independent vertically, so are their dimensional tolerances. Both entities remain free of constraints or built-in stresses even when one or the other or both of them depart from the nominal configuration. The mutually cooperating buttress surfaces of the room elements and bracing means can give a direct transmission of wind force, so that the bracing construction prevents horizontal motion of the building, thereby relieving the moment-resistant connection of the vertical load-bearing structures to the floor panel structure of bending streses due to wind loading.

The buttressing surfaces of the room element may be provided by buttress shoes connected to the floor panel structure. The bracing means may be releasably connected to the buttress shoes. The buttress shoes may be adjustable relative to the floor panel structure to enable the buttress surfaces thereof to be moved into cooperating engagement with the buttress surfaces of the bracing means. Said buttress shoes may comprise angle members one limb of each of which is connected to the floor panel structure and the other limb of each of which provides a said buttressing surface. At least some of said buttressing surfaces may be of sufficient vertical extent to enable the buttressing surfaces to make cooperating engagement should the relation of the bracing means to the room element in a finished building depart from nominal, e.g. due to manufacturing tolerances or settling of the building. The floor panel structure may be provided with bearing surfaces with which the buttress shoes make sliding contact, the buttress shoes being flexible in adjusted position relative to said bearing surfaces. Preferably said bearing surfaces and at least those parts of the buttress shoes which make contact therewith are of steel so that the buttress shoes can be permanently fixed in adjusted position by welding. Means may be provided for temporarily attaching the buttress shoes to the floor panel structure, the temporary attachment means being removable when the buttress shoes are permanently fixed in adjusted position.

The bracing means is preferably of storey height. The bracing means may comprise upper and lower coupling means whereby it can be connected to the foundation of a building and/or to the bracing means of a like vertically adjacent room element. The coupling means may comprise vertically oriented centering means, e.g., in the form of at least one vertically oriented projection on the upper or lower coupling means and a complementary aperture or apertures in the lower or upper coupling means.

The bracing means may comprise spaced uprights. A said coupling means may be provided at the upper and lower end of each spaced upright. The bracing means may further comprise at least one cross-member connecting the spaced uprights to one another, which cross-member may extend between the upper ends of the spaced uprights. The bracing means may also comprise crossed diagonal stays each of which extends from adjacent the upper end of one upright to adjacent the lower end of the other upright. The bracing means may be of steel girder construction. Alternatively, or in addition, the bracing means may comprise one or more solid panels.

The bracing means may comprise oppositely directed buttressing surfaces adapted to cooperate with oppositely directed buttressing surfaces of the room element. Where the bracing means comprises spaced uprights, the uprights may each provide one of the buttressing surfaces.

The floor panel structure may have spaced apertures therein in which said uprights are received. Said apertures may be in a side margin of the floor panel structure or may be intermediate opposite side margins of the floor panel structure, e.g., on the longitudinal centre-line of the floor panel structure.

The floor panel structure is preferably a load-bearing structure of reinforced concrete. The floor panel structure may be formed in one piece or may be formed from two or more floor panel sections connected end-to-end by structural means such as post-tensioning means.

The vertical load-bearing structure or structures may be of reinforced concrete, and may be connected to the floor panel structure by suitable structural means such as post-tensioning means. The or each vertical load-bearing structure may comprise a wall, e.g., an end wall, of the room element or may comprise one or more load-bearing columns.

The invention also provides a method of constructing a plural storey building, the method comprising:

a. taking a plurality of prefabricated transportable room elements each comprising a floor panel structure and at least one vertical load-bearing structure extending upwardly of the floor panel structure and each having bracing means releasably connected thereto, the room element and the bracing means each having buttressing surfaces, b. stacking the room elements one upon another on a foundation with the bracing means of the room elements vertically aligned, c. connecting the bracing means of the lowermost room element to the foundation and the bracing means of the plurality of room elements to one another, d. ensuring that the buttressing surfaces of each room element and its associated bracing means are in cooperating engagement so that horizontal loads on the room element will be transmitted to the bracing means, and e. disconnecting each bracing means from its associated room element so as to permit relative vertical movement between the room element and the bracing means.

Each bracing means may be at least partially disconnected from its associated room element before, during or after placing the room element in stacked position so that the room element and bracing means can be independently aligned with an adjacent stacked room element and bracing means.

The buttressing surfaces of each room element may, as hereinbefore described, be provided by buttress shoes which are adjustable in buttressing direction and the method may further comprise adjusting the buttress shoes so that the buttressing surfaces thereof are in cooperating engagement with the buttressing surfaces of the associated bracing means. The method may further comprise permanently fixing said buttress shoes in adjusted position, e.g., by welding. The bracing means of each room element may be releasably connected to the buttress shoes of that room element and the bracing means may be disconnected from said buttress shoes when the buttress shoes are permanently fixed in adjusted position.

The invention further provides bracing means comprising means whereby the bracing means can be releasably connected to a room element, upper and lower coupling means whereby the bracing means can be connected to the foundation of a building and/or to like bracing means, and oppositely directed buttressing surfaces for cooperation with oppositely directed buttressing surfaces of a room element.

The invention will be further described with reference to the accompanying drawings, in which.

Figure 1:
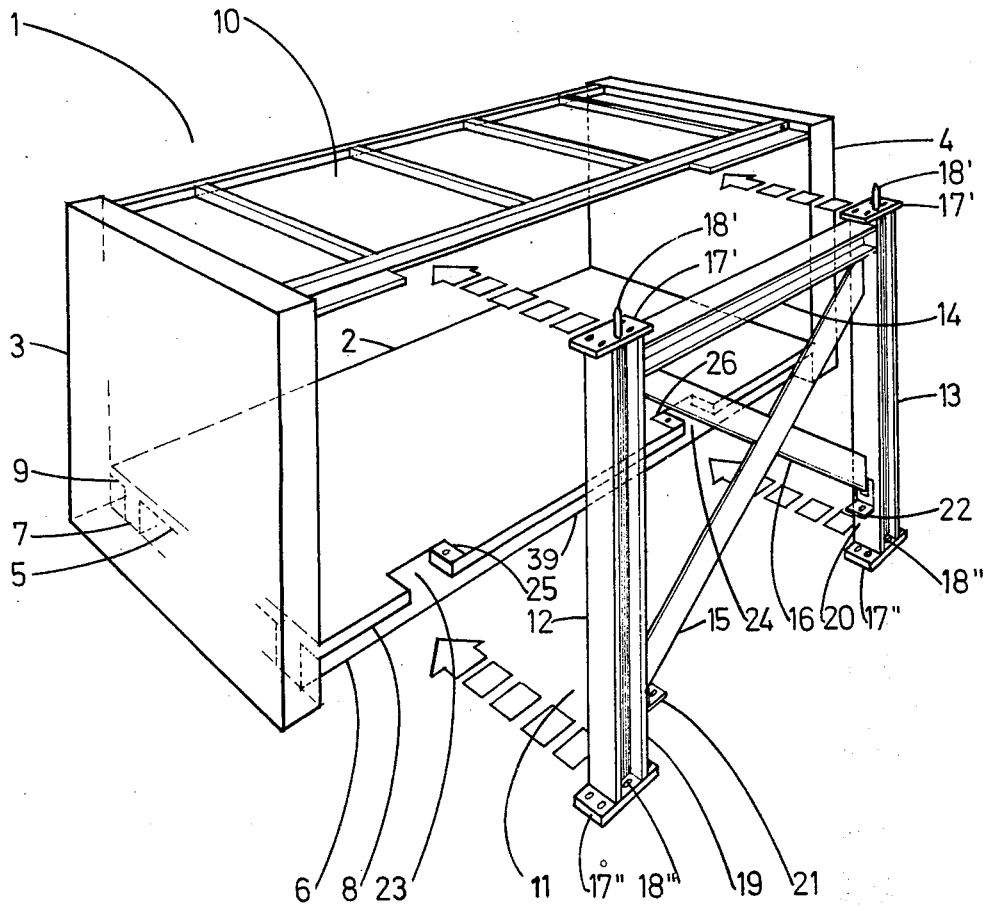
FIG. 1 shows a room element and bracing structure according to the present invention in exploded perspective view.

Referring to FIG. 1, the room element 1 has a rectangular load-bearing floor panel structure 2, to the ends of which are connected vertical load-bearing end structures 3 and 4. The expression "floor panel structure" is to be understood in the broadest sense, including for example a construction assembled from segments or sections. In the present case the floor panel structure comprises a slab 5 with ribs 6 and 7 longitudinally disposed on the underside and set-in from the side edges thereof, leaving laterally protruding cantilever edge portions 8 and 9 of the slab 5. Prestressing members (not shown) may extend through longitudinal ribs 6 and 7 to provide a means of connecting the end structures 3 and 4 to the floor panel structure 2. The expression "vertical load-bearing end structure" is also to be understood in the broadest sense, e.g. to include a closed ring or U-shaped portal frame or one or more vertical columns. In other words, the end structures 3 and 4 schematically represent whatever vertical load-bearing members are associated with the open-sided room element. Such members may be at locations other than the outermost extremities of the floor panel structure, or may be more or less than two in number. The instant example of a room element is further fitted with a ceiling construction 10. In addition, the room element may be partially or completely finished and outfitted, including for instance surface finishes and glazing and installations such as electrical wiring, electrical fittings, gas pipes, plumbing, sanitary installations, and the like.

Such room elements are mounted face-to-face, e.g. side-by-side, end-to-end and/or end-to-side, in layers to form a multi-storey building. The juxtaposed and superposed vertical structures cooperate to form inherent wind-bracing means in their common major planes (i.e. at right angles to the longitudinal axes of the room elements). With respect to wind forces acting at right angles to their major plane, the vertical structures can only offer the resistance provided by their moment-resistant connection to the floor panel structure 2. This connection must normally accommodate not only the forces imposed directly upon the associated vertical structure, but also the much more appreciable load taken up by the vertical structures of the room elements above and transmitted down. With this in mind, the room element 1 is provided with a wind-bracing structure 11 comprising two mutually parallel vertical members 12 and 13, a cross member 14 connecting their upper ends and two diagonal ties 15 and 16. Mating coupling flanges 17', 17'' are mounted at the top and bottom ends of members 12 and 13, flange 17' having a centering pin and flange 17'' a complementary aperture for receiving same.

Figure 2:
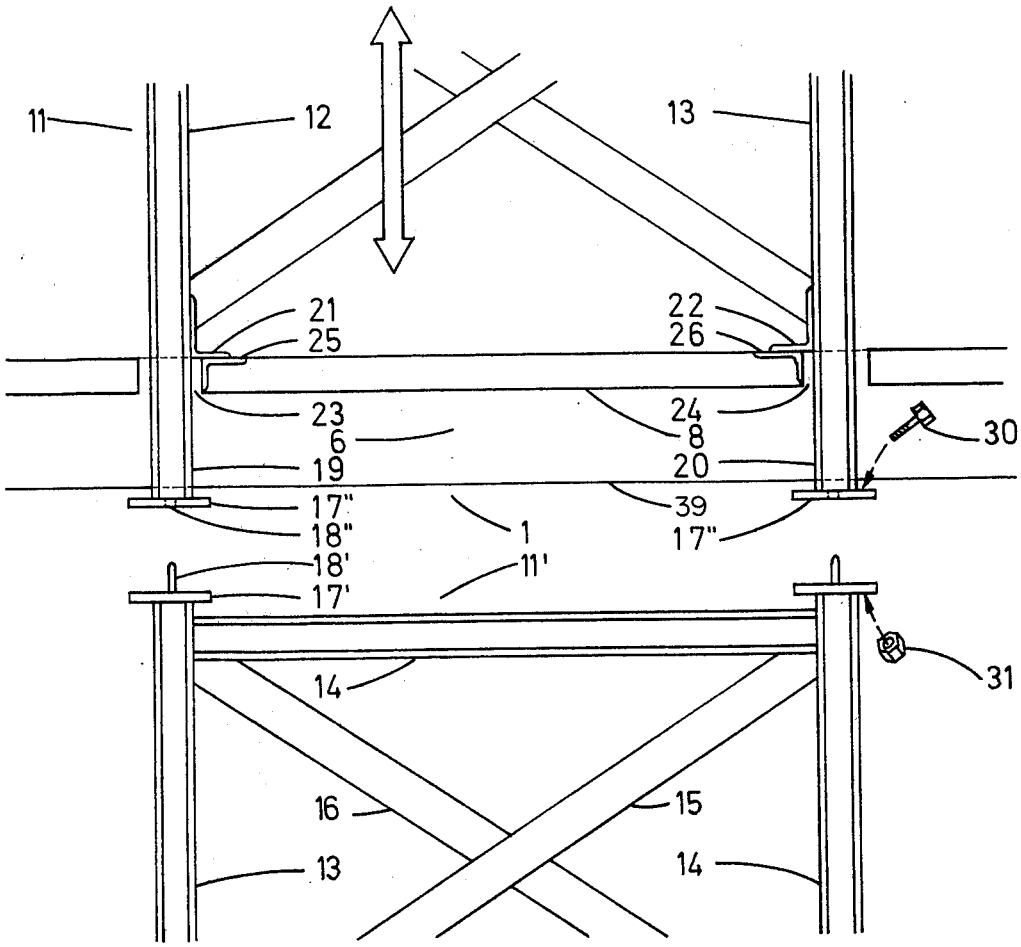
FIG. 2 is a fragmentary side elevation of two constructions according to FIG. 1 being stacked one upon the other.
Figure 3:
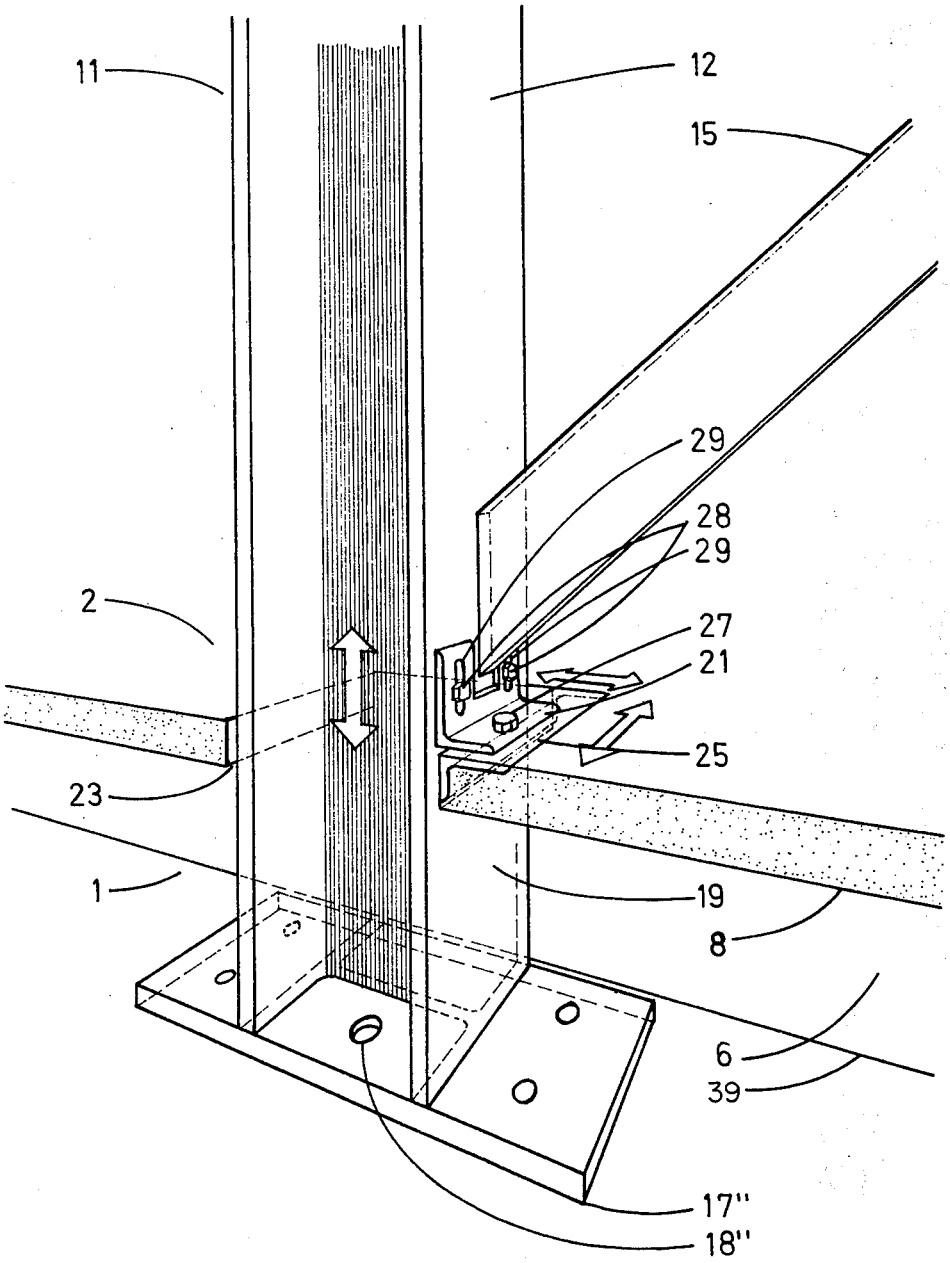
FIG. 3 is a fragmentary detail view according to FIGS. 1 and 2.

The bracing structure 11 has a pair of shafts 19, 20 formed by the free lower ends of the vertical members 12 and 13, upon the opposing faces of which slidable buttressing shoes 21 and 22 are mounted by screw means. The cantilevered edge portion 8 of the floor panel structure has two openings 23, 24 to accommodate the shafts 19 and 20. Bearing surfaces 25, 26 are mounted on the inner edges of openings 23 and 24 and anchored to the cantilever portions 8 of the slab. If the bracing structure 11 is inserted into the room element as indicated by the arrow in FIG. 1, the buttress shoes 21 and 22 will bear on the bearing surfaces 25 and 26 and can be fastened thereto by means of screws 27 visible in FIG. 3. The buttress shoes 21 and 22 form the buttressing surfaces of the floor panel structure 2 and shafts 19 and 20 the counterbutts of the bracing structure. The bracing structure is releasably fixed to the buttress shoes 21 and 22 of the floor panel structure by means of the screws 28 visible in FIG. 3. Screws 28 engage elongated slots 29 in the buttress shoes 21 and 22 so that the bracing structure 11 while fixed to the floor panel 2 can be adjusted vertically relative to the room element. The storey-high bracing structure 11 can thus be mounted in a position low enough to assure that — as can be seen in FIG. 2 — coupling flanges 17'' extend slightly below the bottom edges 39 of longitudinal ribs 6 and therefore below the plane of the mounting surfaces of the room element 1.

Figure 4:
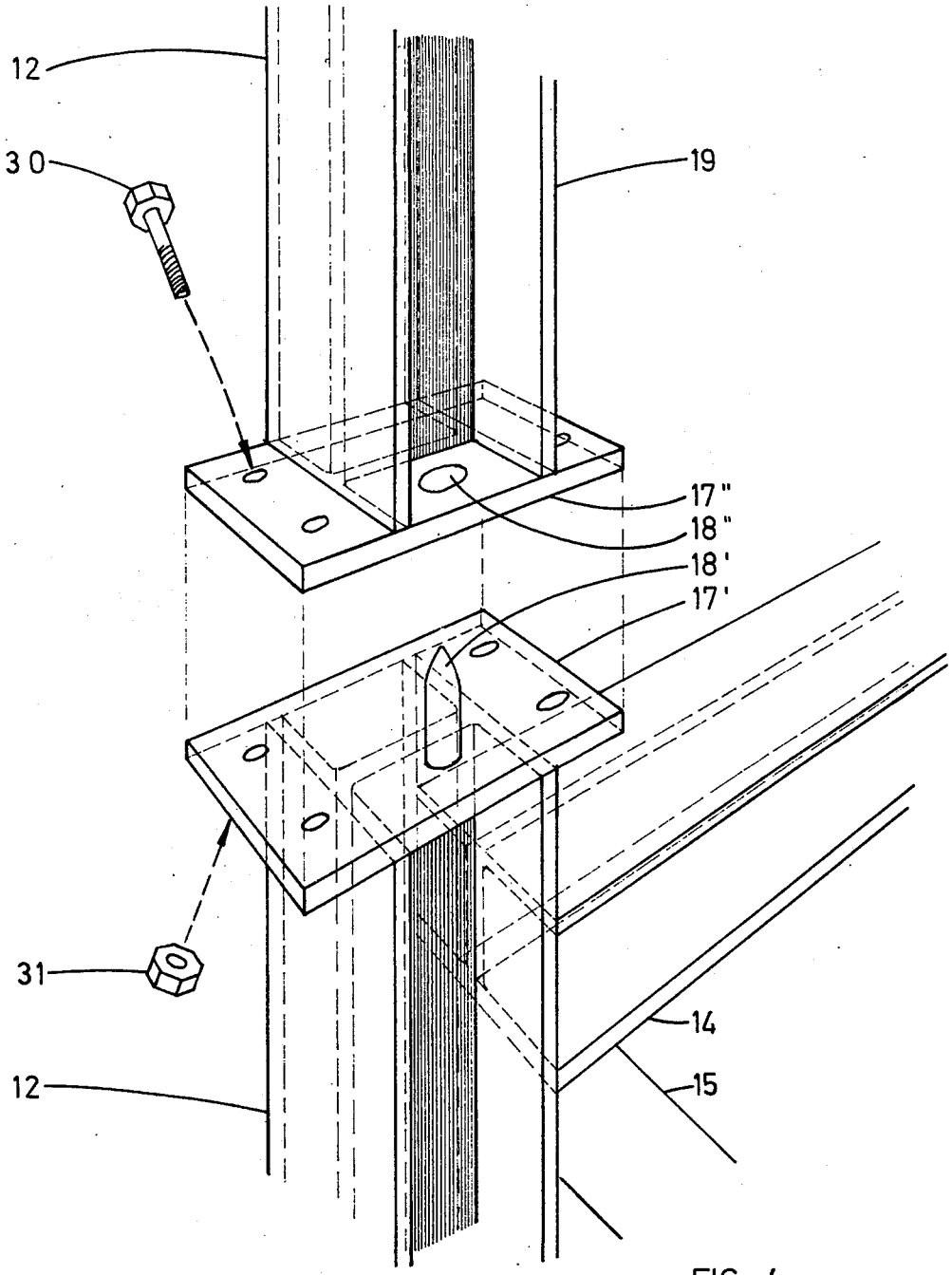
FIG. 4 is a fragmentary detail view according to FIGS. 1 and 2.
Figure 5:
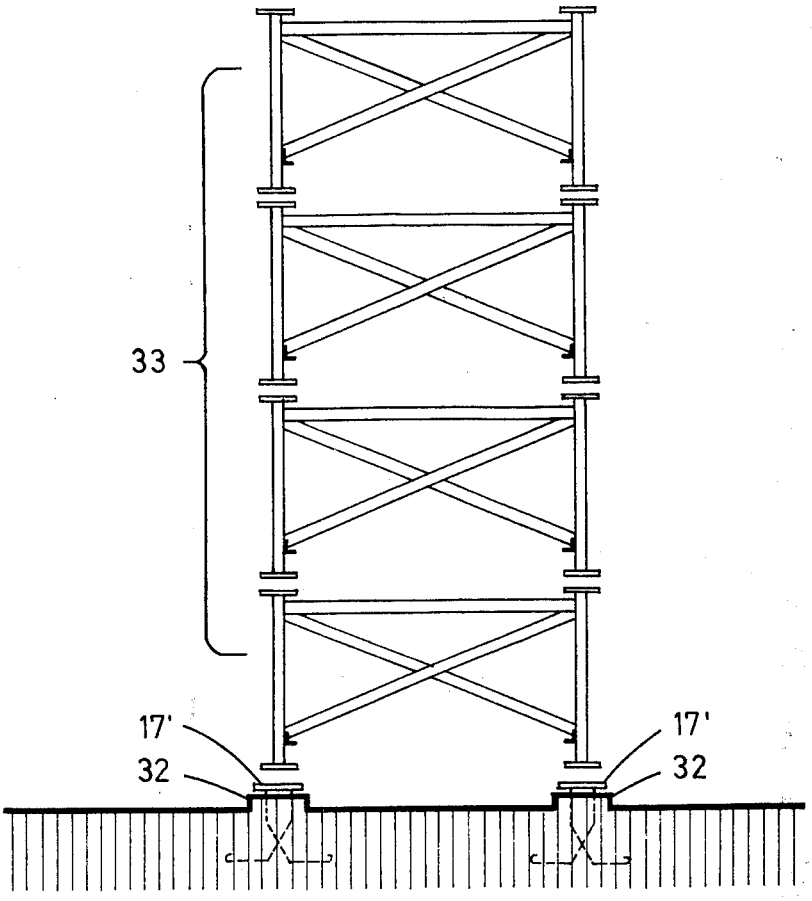
FIG. 5 is an exploded side view of a wind-bracing frame comprising a plurality of storey-high bracing structures.

If a room element that is fitted with a bracing structure 11 is transported from the factory to the building site and there mounted upon an already erected room element which is also fitted with a bracing structure (11' in FIG. 2), the centering pins 18' of the upper coupling flange 17' of the bracing structure 11' of the already erected room element will engage the locating apertures 18'' of the lower coupling flanges 17'' of the bracing structure 11 of the room element 1 being erected, such that the mating coupling flanges 17' and 17'' of said bracing structures 11 and 11' are located with respect to one another. At this stage they can be fastened together by means of screw means 30, 31 as indicated in FIGS. 2 and 4. More important however is the release of the connection between the bracing structure 11 and the room element 1. The foundations 32 are also fitted with coupling flanges 17' to which the coupling flanges 17'' of the lowermost room element are connected in order to provide anchoring means for the entire wind bracing frame. As can be envisioned from the schematic view of FIG. 5, a wind-bracing frame 33 anchored in the foundations 32 rises step-by-step in parallel with the stacking of the room elements 1 and is constituted by the individual bracing structures of superimposed room elements connected together via their coupling flanges. The exact sequence of manipulation or details of construction are of secondary importance. The bracing structure may be installed in its room element in such manner that the coupling flanges 17'' extend below the plane of the mounting surface 39. With this arrangement, as a room element 1 is lowered into place, its bracing structure 11 can be (perhaps only temporarily) coupled to that of the one below, followed by release of the connection between buttress shoes 21 and 22 and the shafts 19 and 20 and then by the setting of the room element itself in position. On the other hand, the bracing structure can be so installed that its coupling flanges 17'' remain above the plane of the mounting surface 39. In this case the room element is first set in place and then the bracing structure released, lowered into engagement with a lower bracing structure of the foundation and connected. Finally, the bracing structure can be so installed that its coupling flanges 17'' lie in the plane of the mounting surface 39 and engage the flanges below simultaneously with the positioning of the room element. Whatever procedure is followed, two independent structural entities result, i.e. a stack of room elements and an integral (" monolithic") wind-bracing frame made from the individual wind-bracing structural modules transported and erected with each room element. Each of these two structural entities is subject only to its own relevant design factors (of which the inherent dimensional tolerances are the determining factors), as long as the connection between each bracing structure and its room element is released at an appropriate time.

Figure 6:
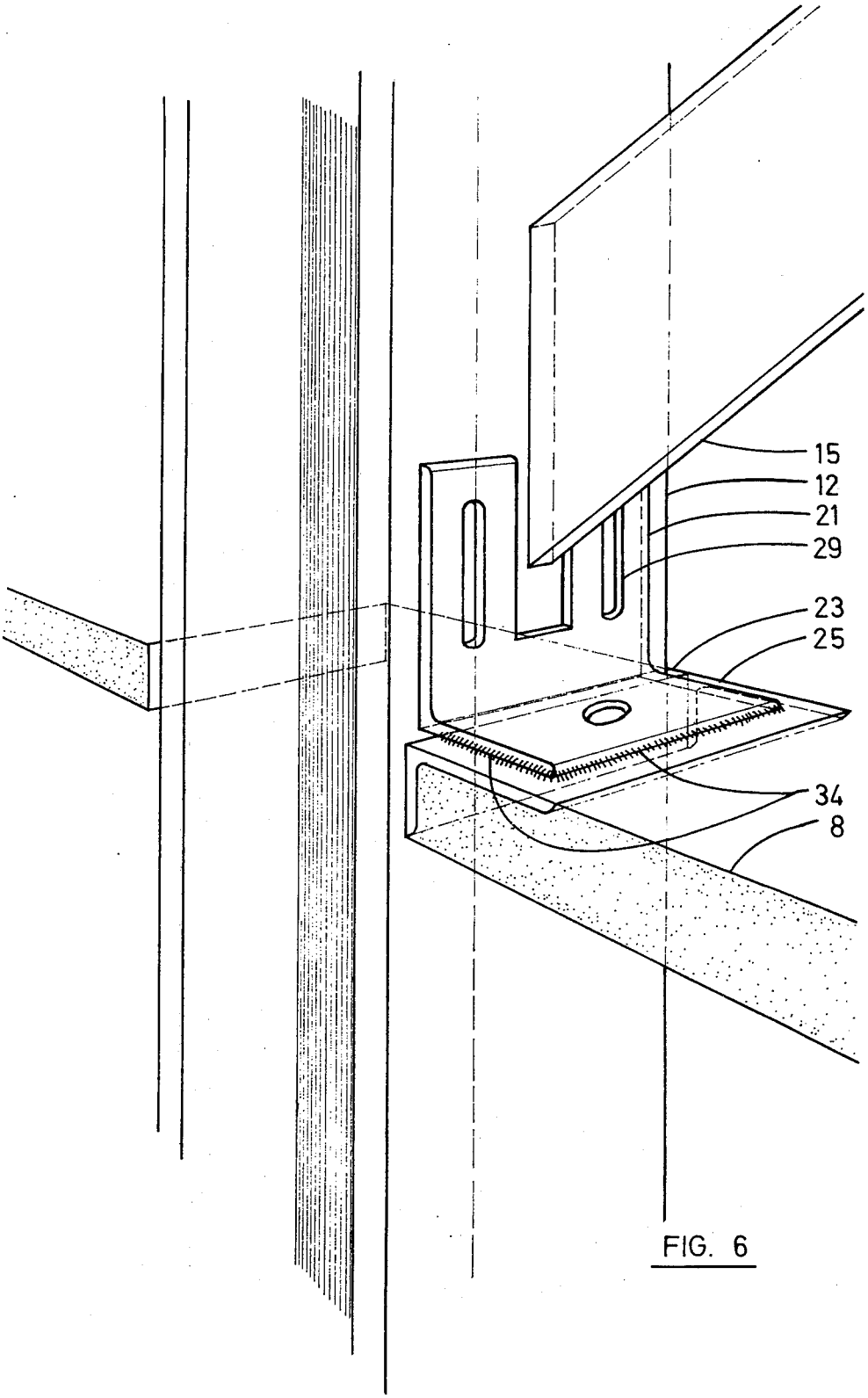
FIG. 6 is an enlarged fragmentary detail view of FIG. 3 at a later stage of erection.

At any time after a room element has been set in position and its bracing structure adjusted and anchored, buttress shoes 21 and 22 of the floor panel structure are definitively adjusted so that the buttressing surfaces thereof are in engagement with the buttressing surfaces of shafts 19 and 20, and then anchored. To this end, screw 27 is loosened and the corresponding buttress shoe is adjusted with the help of screws 28 with respect to the counterbutt formed by shafts 19 and 20. Pads of neoprene, Teflon or similar material can be interposed between the buttressing surfaces if desired. After buttress shoes 21 have been thus adjusted, they are definitively fixed to the floor panel. For this purpose buttress shoes 21 and 22 may be welded to the bearing surfaces 25 and 26, which are let into the floor panel, as indicated at 34 in FIG. 6. Afterwards the connection between the buttress shoes and the counterbutt can be definitively released by removing screws 28 entirely, producing the final condition depicted in FIG. 6. Both said structural entities are from this point on independent of one another in the vertical direction and if one or the other of them should deform due to settlement or temperature change it cannot give rise to stresses in the other or be itself constrained by the other. On the other hand, the wind-bracing frame 33 horizontally stabilizes the floor panel of each room element 1. This is true even during erection, so the building is stabilized during all phases of erection. Depending on the length of the building, stacks of room elements having bracing structures can be erected at one or at several separate locations. The resulting wind-bracing frames need not, of course, extend through the entire height of the building, since the upper say two or three storeys, according to conditions, could be erected without bracing. In special cases stacks of room elements fitted with bracing structures can also be erected end-to-end producing two or more wind bracing frames in tandem. The two or more wind bracing frames need not be of the same height. From the above it should be clear that the most varied conditions which might arise from case to case can be accommodated.

Figure 7:
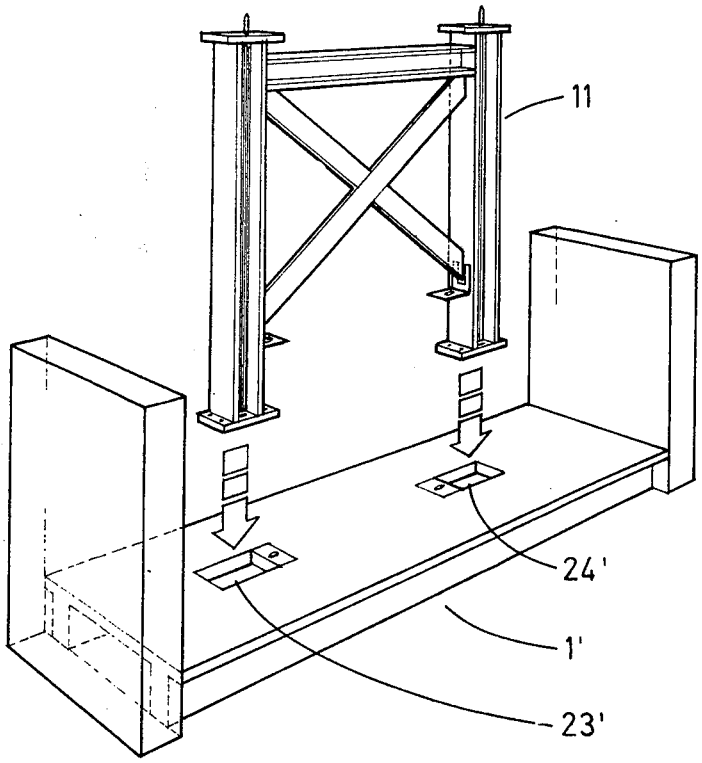
FIG. 7 is an exploded perspective view of an alternative embodiment of the invention.

Referring now to FIG. 7 it will be seen that the bracing structure 11 need not be mounted at the outer edge of the room element 1', but can be located in the interior portion of the slab, here on the longitudinal centerline. It could also be installed at right angles to the longitudinal axis of the room element should such be required. The principles previously disclosed are equally applicable in these arrangements. The arrangement of FIG. 7 may be employed when the longitudinal ribs 6, 7 of the floor panel do not leave a cantilever portion of the slab free at the outer edge, or not a sufficiently wide one, and either arrangement may be used when required by special floor-planning considerations. It is to be understood that the bracing structure need not be of steel. An execution in concrete is equally plausible, to mention only one possibility, although it is always advisable to employ the lightest possible construction in order not to unnecessarily complicate transport and erection of the room elements. Countless modifications of the buttress shoes and coupling members are possible.

What we claim is:

1. A method of constructing a plural storey building, the method comprising:

a. taking a plurality of prefabricated transportable room elements each comprising a floor panel structure and at least one vertical load-bearing structure extending upwardly of the floor panel structure and each having bracing means releasably connected thereto, the room element and the bracing means each having buttressing surfaces, b. stacking the room elements one upon another on a foundation with the bracing means of the room elements vertically aligned, c. connecting the bracing means of the lowermost room element to the foundation and the bracing means of the plurality of room elements to one another, d. ensuring that the buttressing surfaces of each room element and its associated bracing means are in co-operating engagement so that horizontal loads on the room element will be transmitted to the bracing means, and e. disconnecting each bracing means from its associated room element so as to permit relative vertical movement between the room element and the bracing means.

2. A method according to claim 1, wherein each bracing means is at least partially disconnected from its associated room element before, during or after placing the room element in stacked position so that the room element and bracing means can be independently aligned with an adjacent stacked room element and bracing means.

3. A method according to claim 1, wherein the buttressing surfaces of each room element are provided by buttress shoes which are adjustable in buttressing direction and which comprises adjusting said buttress shoes so that the buttressing surfaces thereof are in co-operating engagement with the buttressing surfaces of the associated bracing means.

4. A method according to claim 3, which comprises permanently fixing said buttress shoes in adjusted position.

5. A method according to claim 4, which comprises welding said buttress shoes in adjusted position.

6. A method according to claim 4, wherein the bracing means of each room element is releasably connected to the buttress shoes of that room element and wherein the bracing means is disconnected from said buttress shoes when the buttress shoes are permanently fixed in adjusted position.

* * * * *